US008480257B2

(12) United States Patent
Shang et al.

(10) Patent No.: US 8,480,257 B2
(45) Date of Patent: Jul. 9, 2013

(54) LED LAMP

(75) Inventors: Yun Shang, ShangHai (CN); Ruojian Zhu, ShangHai (CN); Yanlin Xu, ShangHai (CN)

(73) Assignee: GE Lighting Solutions LLC, Cleveland, OH (US)

( * ) Notice: Subject to any disclaimer, the term of this patent is extended or adjusted under 35 U.S.C. 154(b) by 0 days.

(21) Appl. No.: 13/336,392

(22) Filed: Dec. 23, 2011

(65) Prior Publication Data

US 2012/0170267 A1 Jul. 5, 2012

Related U.S. Application Data

(63) Continuation of application No. PCT/CN2010/002225, filed on Dec. 31, 2010.

(51) Int. Cl.
*F21V 33/00* (2006.01)

(52) U.S. Cl.
USPC ..... 362/255; 362/311.02; 362/363

(58) Field of Classification Search
USPC ..... 362/255, 254, 311.02, 363
See application file for complete search history.

(56) References Cited

U.S. PATENT DOCUMENTS

| | | | | |
|---|---|---|---|---|
| 7,602,559 | B2 | 10/2009 | Jang et al. | |
| 2009/0310368 | A1 | 12/2009 | Incerti et al. | |
| 2010/0027270 | A1* | 2/2010 | Huang et al. | 362/310 |
| 2011/0063835 | A1* | 3/2011 | Rivas et al. | 362/235 |

FOREIGN PATENT DOCUMENTS

| | | | |
|---|---|---|---|
| CN | 101067487 | A | 11/2007 |
| CN | 101479522 | A | 7/2009 |

OTHER PUBLICATIONS

PCT Search Report and Written Opinion dated Sep. 22, 2011 from corresponding Application No. PCT/CN2010/002225.

* cited by examiner

*Primary Examiner* — Laura Tso
(74) *Attorney, Agent, or Firm* — Fay Sharpe LLP

(57) ABSTRACT

A light emitting apparatus having a light transmissive envelope and a light emitting diode light source illuminating the interior of the light transmissive envelope. A thin film dissects the light transmissive envelope. The thin film is both refractive and reflective.

21 Claims, 3 Drawing Sheets

LED LAMP

This application is a continuation of PCT/CN2010/002225, filed Dec. 31, 2010, the disclosure of which is herein incorporated by reference.

BACKGROUND

The following relates to the illumination arts, lighting arts, solid-state lighting arts, and related arts.

Incandescent and halogen lamps are conventionally used as both omni-directional and directional light sources. Omni-directional lamps are intended to provide substantially uniform intensity distribution versus angle in the far field, greater than 1 meter away from the lamp, and find diverse applications such as in desk lamps, table lamps, decorative lamps, chandeliers, ceiling fixtures, and other applications where a uniform distribution of light in all directions is desired.

With reference to FIG. 1, a coordinate system is described which is used herein to describe the spatial distribution of illumination generated by an incandescent lamp or, more generally, by any lamp intended to produce omnidirectional illumination. The coordinate system is of the spherical coordinate system type, and is shown with reference to an incandescent A-19 style lamp L. For the purpose of describing the far field illumination distribution, the lamp L can be considered to be located at a point L0, which may for example coincide with the location of the incandescent filament. Adapting spherical coordinate notation conventionally employed in the geographic arts, a direction of illumination can be described by an elevation or latitude coordinate and an azimuth or longitude coordinate. However, in a deviation from the geographic arts convention, the elevation or latitude coordinate used herein employs a range [0°, 180°] where: θ=0° corresponds to "geographic north" or "N". This is convenient because it allows illumination along the direction θ=0° to correspond to forward-directed light. The north direction, that is, the direction θ=0°, is also referred to herein as the optical axis. Using this notation, θ=180° corresponds to "geographic south" or "S" or, in the illumination context, to backward-directed light. The elevation or latitude θ=90° corresponds to the "geographic equator" or, in the illumination context, to sideways-directed light. It will be appreciated that at precisely north or south, that is, at θ=0° or at θ=180° (in other words, along the optical axis), the azimuth or longitude coordinate has no meaning, or, perhaps more precisely, can be considered degenerate. Another "special" coordinate is θ=90° which defines the plane transverse to the optical axis which contains the light source (or, more precisely, contains the nominal position of the light source for far field calculations, for example the point L0).

In practice, achieving uniform light intensity across the entire longitudinal span θ=[0°, 360°] is typically not difficult, because it is straightforward to construct a light source with rotational symmetry about the optical axis (that is, about the axis θ=0°. For example, the incandescent lamp L suitably employs an incandescent filament located at coordinate center L0 which can be designed to emit substantially omnidirectional light, thus providing a uniform intensity distribution with respect to the azimuth θ for any latitude.

However, achieving ideal omnidirectional intensity with respect to the elevational or latitude coordinate is generally not practical. For example, the lamp L is constructed to fit into a standard "Edison base" lamp fixture, and toward this end the incandescent lamp L includes a threaded Edison base EB, which may for example be an E25, E26, or E27 lamp base where the numeral denotes the outer diameter of the screw turns on the base EB, in millimeters. The Edison base EB (or, more generally, any power input system located "behind" the light source) lies on the optical axis "behind" the light source position L0, and hence blocks backward emitted light (that is, blocks illumination along the south latitude, that is, along) θ=180°, and so the incandescent lamp L cannot provide ideal omnidirectional light respective to the latitude coordinate.

Commercial incandescent lamps, such as 60 W Soft White incandescent lamps (General Electric, New York, USA) are readily constructed which provide intensity across the latitude span θ=[0°, 135°] which is uniform to within ±20% of the average intensity over that latitude range.

By comparison to incandescent and halogen lamps, solid-state lighting technologies such as light emitting diode (LED) devices are highly directional by nature, as they are a flat device emitting from only one side. For example, an LED device, with or without encapsulation, typically emits in a directional Lambertian spatial intensity distribution having intensity that varies with cos(θ) in the range θ=[0°, 90°] and has zero intensity for θ>90°. A semiconductor laser is even more directional by nature, and indeed emits a distribution describable as essentially a beam of forward-directed light limited to a narrow cone around θ=0°.

Another challenge associated with solid-state lighting is that unlike an incandescent filament, an LED chip or other solid-state lighting device typically cannot be operated efficiently using standard 110V or 220V a.c. power. Rather, on-board electronics are typically provided to convert the a.c. input power to d.c. power of lower voltage amenable for driving the LED chips. As an alternative, a series string of LED chips of sufficient number can be directly operated at 110V or 220V, and parallel arrangements of such strings with suitable polarity control (e.g., Zener diodes) can be operated at 110V or 220V a.c. power, albeit at substantially reduced power efficiency. In either case, the electronics constitute additional components of the lamp base as compared with the simple Edison base used in integral incandescent or halogen lamps. The space occupied by the electronics can create a further light transmissive impediment.

Yet another challenge in solid-state lighting is the need for heat sinking. LED devices are highly temperature-sensitive in both performance and reliability as compared with incandescent or halogen filaments. This is addressed by placing a mass of heat sinking material (that is, a heat sink) in contact with or otherwise in good thermal contact with the LED device. The space occupied by the heat sink blocks emitted light and hence further limits the ability to generate an omnidirectional LED-based lamp. This limitation is enhanced when a LED lamp is constrained to the physical size of current regulatory limits (ANSI, NEMA, etc.) that define maximum dimensions for all lamp components, including light sources, electronics, optical elements, and thermal management.

The combination of electronics and heat sinking makes it difficult to position LED devices at the L0 location. Accordingly, the majority of commercially available LED lamps intended as incandescent replacements do not provide a uniform intensity distribution that is similar to incandescent lamps. Moreover, the light intensity distribution is mainly upwardly directed, with little light emitted below the equator. This does not provide an intensity distribution, which satisfactorily emulates an incandescent lamp.

BRIEF SUMMARY

According to a first aspect of the present disclosure, a light emitting apparatus including a light transmissive envelope is provided. A light emitting diode light source illuminates the interior of the light transmissive envelope. A thin film dissects the light transmissive envelope. The thin film is both refractive and reflective.

According to a second aspect of the present disclosure, a lamp comprising a light engine including a plurality of light emitting diodes is provided. The lamp further includes a base housing LED drive electronics conditioned to convert alternating current to direct current. An electrical connector is disposed on a first side of the base and a light transmissive body is disposed on a second side of the base. Light emitted by the light engine enters the light transmissive body. The light transmissive body further includes a thin film layer extending substantially perpendicular to an optical axis of the lamp. The thin film layer is both reflective and refractive.

According to a third aspect of the present disclosure, a lamp comprising a light transmissive envelope in combination with a base housing LED drive electronics conditioned to convert alternating current to direct current is provided. An LED light source illuminates the interior of the light transmissive envelope. A thin film is disposed on a surface of the light transmissive envelope. The thin film is both reflective and refractive. A screw, wedge or post connector is also provided.

BRIEF DESCRIPTION OF THE DRAWINGS

The invention may take form in various components and arrangements of components, and in various process operations and arrangements of process operations. The drawings are only for purposes of illustrating embodiments and are not to be construed as limiting the invention.

DETAILED DESCRIPTION OF PREFERRED EMBODIMENTS

The present embodiment is directed to an integral replacement LED lamp, where the input to the lamp is the main electrical supply, and the output is the desired intensity pattern, preferably with no ancillary electronic or optical components external to the lamp.

Figure 1:
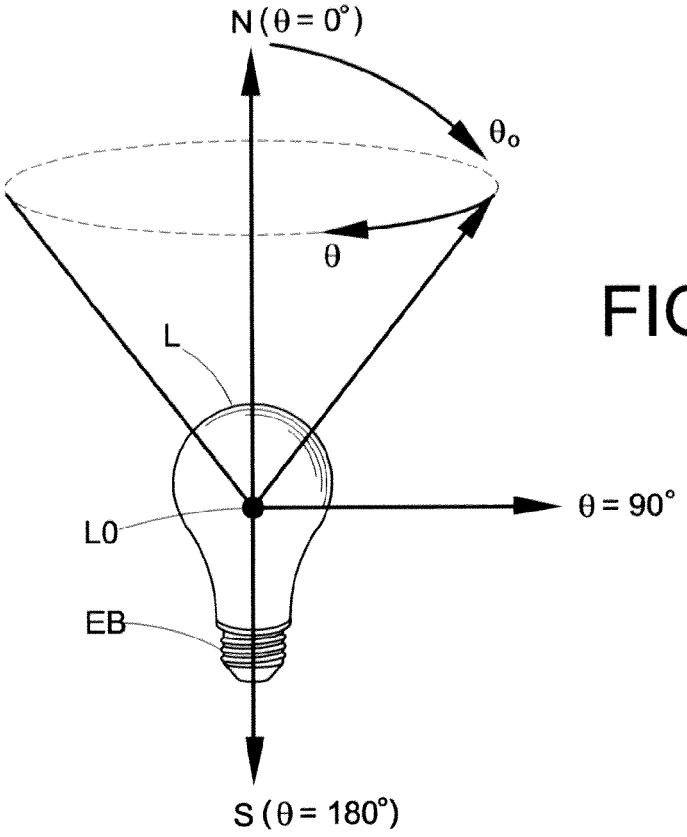
FIG. 1 diagrammatically shows, with reference to a conventional incandescent light bulb, a coordinate system that is used herein to describe illumination distributions.
Figure 2:
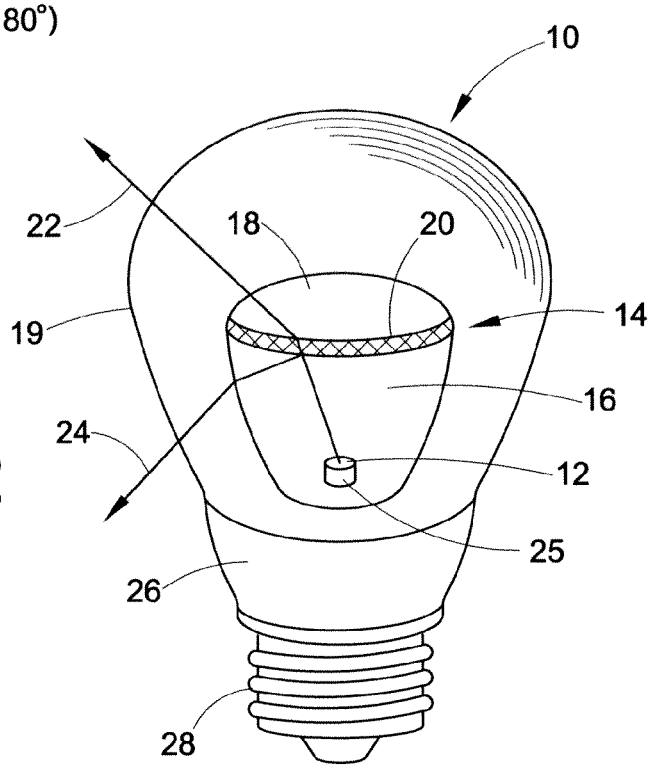
FIG. 2 diagrammatically shows an omnidirectional LED-based lamp of the present disclosure in cross-section.

With reference to FIG. 2, an LED-based lamp 10 includes an LED-based light source 12 and a light-transmissive envelope 14. The illustrated light-transmissive envelope 14 is comprised of a first lens portion 16 disposed adjacent the light source 12 and a remote lens portion 18. Thin film 20 is disposed between the first lens portion 16 and remote lens portion 18. It is also contemplated that the lamp 10 may be constructed without remote lens portion 18. Light transmissive envelope 14 can be enclosed within a glass bulb 19 providing the shape of a traditional incandescent lamp.

Thin film 20 is selected from a material and a thickness to provide both transmission of refractive light 22 and reflected light 24. Exemplary materials from which the thin film can be formed include aluminum, silver and gold. It is believed that a thin film having a thickness between about 30 microns and about 50 microns will provide the desired mix of reflection and transmission. By using this approach light intensity distribution can be tailored. Moreover, reflected light can be used to create a substantially omni-directional light distribution while refractive light provides the diffuse sparkle effect associated with incandenscent lamps. Advantageously, by film thickness control, the light intensity distribution can be adjusted without changing the lens design.

In certain embodiments, the envelope 14 is constructed of glass, although other light-transmissive materials, such as plastic or ceramic, are also contemplated. The envelope 14 optionally may also include one or more phosphors, for example coated on the envelope surface or dispersed throughout, to convert the light from the LEDs to another color, for example to convert blue or ultraviolet (UV) light from the LEDs to white light. Alternatively, the phosphor can be associated with the LED package. A further alternative includes dispersing phosphors on or in the bulb 19.

The LED-based light source 12 comprises at least one light emitting diode (LED) device. It is envisioned that the light engine comprised of the LED can be phosphor based systems wherein LED light is used to excite a phosphor or a color blending system wherein different colored LEDs are mixed to produce the desired visible light output. For example, in some embodiments the first LED devices output light can have a greenish rendition (achievable, for example, by using a blue- or violet-emitting LED chip that is coated with a suitable "white" phosphor) and the second LED devices can output red light (achievable, for example, using a GaAsP or AlGaInP or other epitaxy LED chip that naturally emits red light), and the light from the first and second LED devices blend together to produce improved white rendition. On the other hand, it is also contemplated for the LED-based light source to comprise a single LED device, which may be a white LED device or a saturated color LED device or so forth. Laser LED devices are also contemplated for incorporation into the lamp.

The envelope 14 can be hollow or solid. In one embodiment, the light-transmissive envelope 14 includes an opening 25 sized to receive or mate with the LED-based light source 12 such that the light-emissive principle surface of the LED-based light source 12 faces into the interior of the envelope 14 and emits light into the interior of the envelope 14.

The LED-based light source 12 is mounted to a base 26 which provides heat sinking and space to accommodate electronics which convert alternating current to direct current. More particularly, base element 26 further includes a connector 28 for securing the lamp 10 to a power outlet. An Edison screw base is depicted in the present figures, but any type of connector known to skilled artisan is suitable, such as wedge or post connectors. The LED can be mounted in a planar orientation on a circuit board, which is optionally a metal core printed circuit board (MCPCB). The base element 26 provides support for the LED devices and is thermally conductive (heat sinking).

Figure 3:
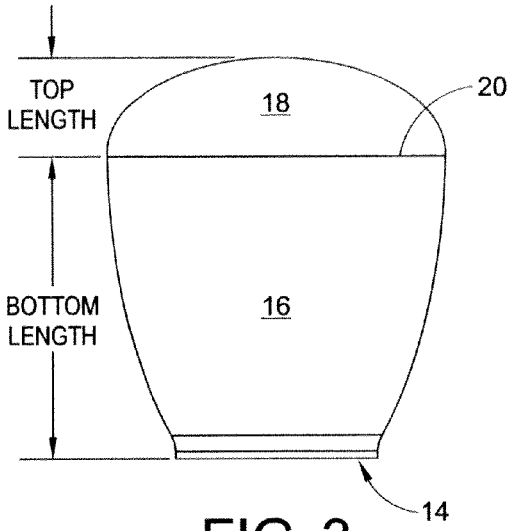
FIG. 3 is a side elevation view of an alternative omnidirectional LED-based lamp.

Referring now to FIG. 3, the concept of varying the height of lens 16 and lens 18 is visually depicted. Moreover, varying the ration between bottom length to top length. It is generally believed that it is desirable for the surface area of lens 16 to be greater than the surface area of lens 18, perhaps constituting >65% of the total light-transmissive envelope, preferably >75%. However, it is believed that the most effective methodology for altering the light distribution of the present embodiment is to modify the thickness of the thin film. Moreover, inverting thin film thickness will achieve greater light reflection in the θ=0° direction. Furthermore, the embodiment provides for a thin film thickness that can differ along the path of the layer. In that regard, it is feasible (for example) to provide relatively thicker regions adjacent the edges of the envelope and a thinner region adjacent the outedr.

Figure 4:
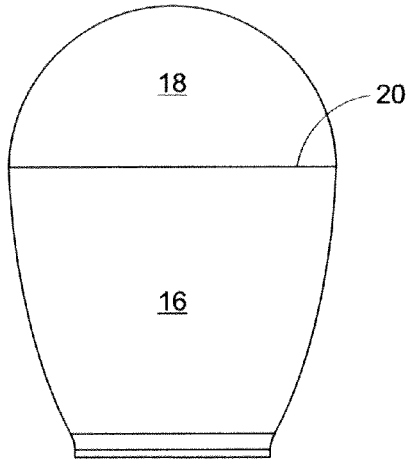
FIG. 4 is a side elevation view of an alternative omnidirectional LED-based lamp.
Figure 5:
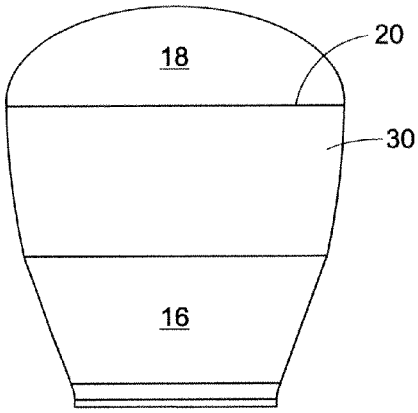
FIG. 5 is a side elevation view of an alternative omnidirectional LED-based lamp.
Figure 6:
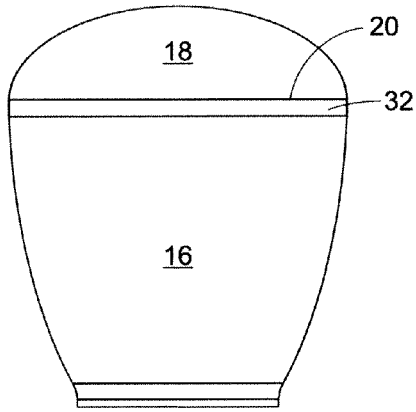
FIG. 6 is a side elevation view of an alternative omnidirectional LED-based lamp.

Referring now to FIGS. 4-6, alternative light-transmissive envelope shapes are depicted. For example, in FIGURE, the lens 18 is generally a spherical shape. FIG. 5 demonstrates that an intermediate lens 30 can be provided. FIG. 6 demonstrates that a transition region 32 between lens 16 and lens 18 may be provided.

Figure 7:
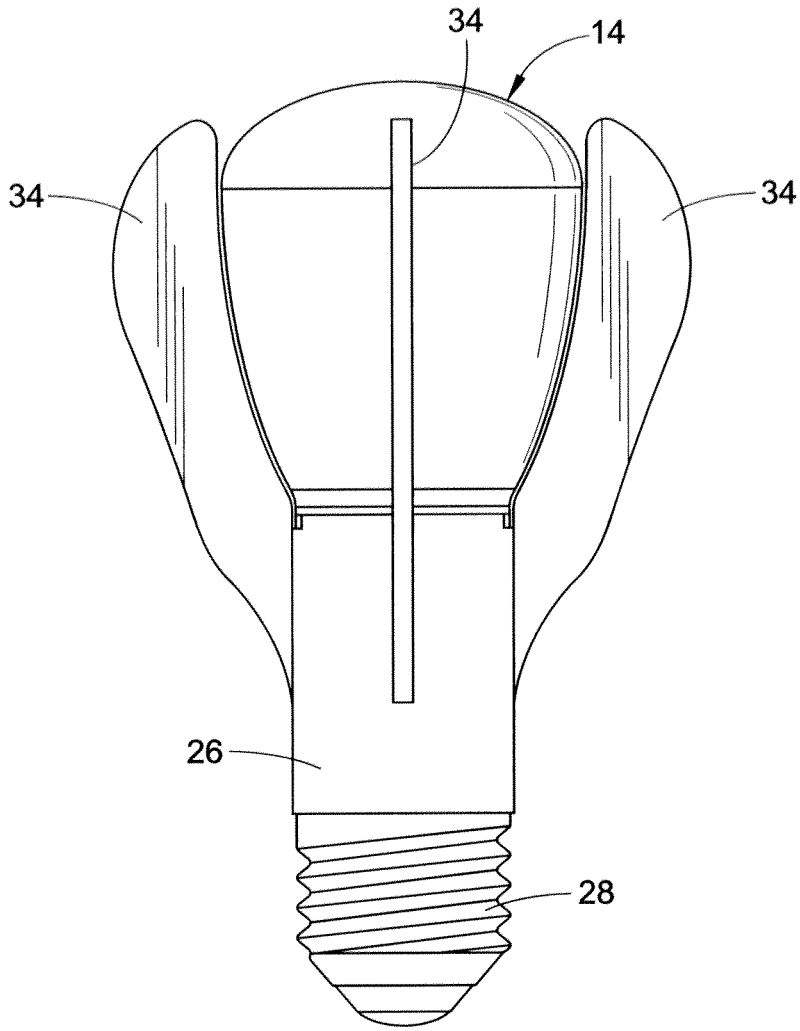
FIG. 7 illustrates an alternative LED-based lamp embodiment in accord with the present disclosure which includes heat sinking fins.

Referring now to FIG. 7, to an alternative lamp embodiment is provided. Particularly, the base 26 is in thermal communication with a plurality of thermally conductive fins 34. The fins 34 extend toward the north pole of the lamp θ=0°, adjacent the envelope 14. The fins 34 can be constructed of any thermally conductive material, ones with high thermal conductivity being preferred, easily manufacturable metals or appropriate moldable plastics being more preferred, and cast or aluminum or copper being particularly preferred. In general, metallic materials have a high thermal conductivity, with common structural metals such as alloy steel, extruded aluminum and copper having thermal conductivities of 50 W/m-K, 170 W/m-K and 390 W/m-K, respectively. A high conductivity material will allow more heat to move from the thermal load to ambient and result in a reduction in temperature rise of the thermal load. Advantageously, it can be seen that the design provides an LED based light source that fits within the ANSI outline for an A-19 incandescent bulb (ANSI C78.20-2003).

Other material types may also be useful for heat sinking applications. High thermal conductivity plastics, plastic composites, ceramics, ceramic composite materials, nano-materials, such as carbon nanotubes (CNT) or CNT composites with other materials have been demonstrated to possess thermal conductivities within a useful range, and equivalent to or exceeding that of aluminum. The emissivity, or efficiency of radiation in the far infrared region, approximately 5-15 micron, of the electromagnetic radiation spectrum is also an important property for the surfaces of a thermal heat sink. Generally, very shiny metal surfaces have very low emissivity, on the order of 0.0-0.2. Hence, some sort of coating or surface finish may be desirable, such as paints (0.7-0.95) or anodized coatings (0.55-0.85). A high emissivity coating on a heat sink may dissipate approximately 40% more heat than a bare metal surface with a low emissivity.

The preferred embodiments have been illustrated and described. Obviously, modifications, alterations, and combinations will occur to others upon reading and understanding the preceding detailed description. It is intended that the invention be construed as including all such modifications and alterations insofar as they come within the scope of the appended claims or the equivalents thereof.

What is claimed is:

1. A light emitting apparatus comprising a light transmissive envelope in combination with a base element, a light emitting diode light source illuminates the interior of the light transmissive envelope, and a thin film dissects said light transmissive envelope, said thin film being both refractive and reflective.

2. The apparatus of claim 1 possessing a substantially omindirectional light intensity distribution.

3. The apparatus of claim 1, wherein said light emitting diode light source is disposed approximately at a location where said light transmissive envelope and said base element intersect.

4. The apparatus of claim 1, wherein said base element includes an electrical connector.

5. The apparatus of claim 1 including LED driver electronics encompassed by the base element.

6. The apparatus of claim 2 having a variation in average light intensity between a 0 and 135° viewing angle of less than ±20%.

7. The apparatus of claim 1, wherein said thin film is comprised of aluminum.

8. The apparatus of claim 7 wherein said thin film has a thickness between about 30 microns and about 50 microns.

9. The apparatus of claim 1 wherein said light transmissive envelope is hollow.

10. The apparatus of claim 1 wherein said light transmissive envelope is substantially solid.

11. The apparatus of claim 1 wherein said light transmissive envelope includes a phosphor material.

12. The apparatus of claim 1 further including a plurality of fins adjacent said light transmissive envelope.

13. A lamp comprising a light engine including a plurality of light emitting diodes, a base housing LED drive electronics conditioned to convert alternating current to direct current, disposed on a second side of an electrical connector disposed on a first side of said base, a light transmissive said base wherein light emitted by said light engine enters said light transmissive body, said light transmissive body further including a thin film layer extending substantially perpendicular to an optical axis of said lamp, said thin film layer being both reflective and refractive.

14. The lamp of claim 13 wherein said thin film layer bisects said light transmissive body.

15. The lamp of claim 13 where said thin film is selected from aluminum, silver and gold.

16. The lamp of claim 13 wherein said electric connector comprises an Edison screw base or a wedge base.

17. The lamp of claim 13 further comprising a phosphor material disposed adjacent said light emitting diodes.

18. The lamp of claim 14 wherein a region of said light transmissive body adjacent said light engine as defined by said thin film layer comprises at least 65% of the surface area of the overall surface area of said light transmissive body.

19. The lamp of claim 13 wherein said thin film is between about 30 microns and about 50 microns thick.

20. A lamp comprising a light transmissive envelope in combination with a base having LED drive electronics conditioned to convert alternating current to direct current, an LED light source illuminating the interior of the light transmissive envelope, an aluminum thin film disposed on a surface of said light transmissive envelope, said thin film having a thickness between about 30 and 50 microns and being both refractive and reflective, and one of a screw, wedge or post connector.

21. The lamp of claim 13 further comprising a phosphor material associated with the light transmissive body.

* * * * *